US005176448A

United States Patent [19]

King et al.

[11] Patent Number: 5,176,448

[45] Date of Patent: Jan. 5, 1993

[54] SPECIAL INJECTION AND DISTRIBUTION DEVICE

[76] Inventors: Leonard T. King, 4109 Cedar Ave., Long Beach, Calif. 90807; Leo Nelmida, 21086 Cantebury La., Lake Forest, Calif. 92630

[21] Appl. No.: 869,626

[22] Filed: Apr. 16, 1992

[51] Int. Cl.[5] ..... B01F 15/02; B01F 5/06

[52] U.S. Cl. ..... 366/167; 366/339

[58] Field of Search ..... 366/336, 337, 338, 339, 366/150, 154, 167, 173, 178; 138/38, 42

[56] References Cited

U.S. PATENT DOCUMENTS 4,614,440 9/1986 King ..... 366/340
4,616,937 10/1986 King ..... 366/336
4,674,888 6/1987 Carlson ..... 366/337
4,753,535 6/1988 King .

FOREIGN PATENT DOCUMENTS 317533 5/1989 Japan .

*Primary Examiner*—Robert W. Jenkins
*Attorney, Agent, or Firm*—Malcolm B. Wittenberg

[57] ABSTRACT

A stationary material mixing apparatus for mixing various components in a fluid stream. The mixing apparatus is a biscuit placed within a conduit along the longitudinal axis of the conduit. The biscuit contains a plurality of openings therethrough where within openings are located mixing elements which induce a rotational angular velocity to the fluid stream. The material mixing apparatus is particularly effective in mixing a low viscosity component into a high viscosity fluid stream.

8 Claims, 4 Drawing Sheets

SPECIAL INJECTION AND DISTRIBUTION DEVICE

TECHNICAL FIELD OF THE INVENTION

The present invention deals with a material mixing apparatus which contains various elements traditionally known as static mixers for mixing components of a fluid stream. The mixer of the present invention is uniquely designed to enhance the mixing of a low viscosity component such as a colorant or dye into a high viscosity fluid stream such as a polymer melt.

BACKGROUND OF THE INVENTION

It has long been realized that static mixers, if made to work efficiently, provide certain economic advantages over dynamic mixers for, as the name implies, static mixers employ no moving parts. As such, static devices are generally less expensive to configure and certainly much less expensive to maintain while providing the user with an extended useful life for the mixer product in service.

Prior art approaches to static mixers have generally involved expensive machining, molding, casting or other fabrication of the component mixer elements coupled with some type of permanent attachment between elements and a conduit and/or between elements within a conduit. The resulting cost and difficulty of manufacturing results in a relatively expensive end product. Moreover, many of the prior mixers provide less than complete mixing, particularly with respect to material flowing along the walls of the conduit. This so called "wall-smearing" is related to the parabolic velocity profile of a fluid having laminar flow in a pipe where the fluid velocity is small or zero along the wall surfaces.

A marked improvement in static mixer technology was represented by the teachings of Applicant's prior U.S. Pat. No. No. 3,923,288. The invention embodied in the cited patent was taught to be a stationary material mixing apparatus comprised of a plurality of self-nesting, abutting and axially overlapping elements which are fit into a conduit. Each region of axial overlap between elements provides a mixing matrix introducing complex velocity vectors into the materials.

In the case of a single input stream into an assembly of "n" mixing elements such as those disclosed in U.S. Pat. No. 3,923,288, one obtains $2^n$ divisions of the stream. This is so because each mixing element involves a $2\times2$ division of the flow stream.

A device capable of increasing the mixing efficiency of mixing elements such as those disclosed in the cited prior art to something greater than $2^n$ divisions was disclosed in Applicant's U.S. Pat. No. 4,614,440. In its broadest terms, Applicant's prior patent taught a stationary material mixing apparatus for mixing a fluid stream which is in the shape of a conduit comprising individual biscuit sections. The sections were aligned along a common longitudinal axis, while each biscuit section comprised a plurality of openings therethrough, where within said openings are located mixing elements which induce a rotational angular velocity to the fluid stream. Substantially all of the mixing elements were taught to induce the same rotational sign to the fluid whereby it was taught that openings in adjacent biscuit sections were purposely misaligned to enhance the mixing operation.

FIG. 1 represents a typical biscuit section as taught in Applicant's prior U.S. Pat. No. 4,614,440. Biscuit element 10, shown in plan view, is provided with a central opening 5 and peripheral openings 6. A biscuit having a hexagonal hold configuration with center hole 5 is typical of those biscuit elements disclosed in Applicant's prior patent.

It was taught that virtually any mixing element could be placed within openings 5, 6, etc., which in part induce a rotational velocity to the fluid passing therethrough. Typical of such elements are those disclosed in U.S. Pat. No. 3,923,288, the disclosure of which is hereby incorporated by reference. Such elements are depicted by numeral 13 of FIGS. 3 and 4, said elements inducing or imparting the same rotational sign to the fluid passing through the biscuit openings.

The sign of rotation of the mixed fluid is shown schematically by elements 31 and 32 of FIG. 2. It was taught in Applicant's U.S. Pat. No. 4,614,440 to provide a number of longitudinally aligned biscuit elements, such as shown as elements 10, 11, etc., of FIG. 3 and to provide for openings in adjacent biscuit elements to be misaligned. This misalignment is typified by the plan view of FIG. 2, whereby the geometric center of hole 6 coincides with the periphery of hole 6*a*, the latter opening appearing in adjacent biscuit element 11. This misalignment is the result of an approximately 30° shift between adjacent biscuits. It was recognized that unless adjacent biscuit elements were misaligned, a fluid injected into an upstream cell or opening, such as opening 6 of FIG. 1, would tend to channel its way through the various downstream biscuit elements, and although the fluid stream would be somewhat mixed, inter cell mixing would not occur. By misaligning biscuit elements such as shown in FIG. 2, each cell of, for example, biscuit 11 would accept or capture material from two cells of biscuit 10, and as such, mixing would be enhanced. As all helical mixing elements 13 are provided with the same sign, the net result of misalignment is to divide and recombine the product many times since each section having helical holes splits and recombines the flow of fluid 12 times.

It was further recognized that as a means of enhancing the mixing phenomenon, it was found preferable to block openings in various biscuit sections. Ideally, the blocked openings were located in alternative biscuits, that is, not in adjacent biscuits and, most preferably, blocked openings would be located in the geometric centers of the various biscuits. FIG. 4 is illustrative of this embodiment wherein biscuits 10, 11 and 12 are shown in exploded perspective view whereby fluid stream 17 is shown emanating from center hole 5 of biscuit element 10. Without the blockage of center hole 5*a* of biscuit 11, the fluid traveling along path 17 would tend to burrow through all of the longitudinally aligned center openings 5, 5*a* and 5*b* without any adjacent hold mixing. By blocking center hole 5*a*, fluid stream traveling through the center opening 5 was caused to proceed through openings 6*a* and 7*a* of biscuit 11 and assume path 17*a*, 17*b*, etc., prior to encountering biscuit 12. At biscuit 12, fluid stream 17*a* and 17*b* was broken up even further for now center hole 5*b*, being unplugged, would accept fluid as well as adjacent mixing openings.

When one or more of the center openings in the system were blocked, it was taught to be preferred to space biscuit elements from one another to enable fluid downstream from a biscuit containing a blocked opening to encounter an unblocked, centrally located opening therein. FIG. 3 is referred to as being illustrative of the invention disclosed in Applicant's U.S. Pat No. 4,464,440 whereby biscuits 10, 11, etc., nested within conduit 20 are notched to provide a nesting or interlocking relationship. Further, internal spacing 40 was provided to enable proper fluid handling in and around biscuits containing centrally blocked openings, which further reduced the pressure drop along the overall conduit.

The stacked motionless mixing device comprising various biscuit sections 10, 11, etc., provided a vastly superior mixing device from that contemplated by the prior art. For example, in the case of a single input stream into an assembly of "n" mixing elements, such as those shown in U.S. Pat. No. 3,923,288, one would obtain $2^n$ divisions of the input stream. However, in practicing the invention shown in U.S. Pat. No. 4,614,440, a 2-inch mixer would behave like a $2^{2n}$ mixer. If one were to provide six peripheral holes in an eight biscuit conduit, instead of having a $6\times2^n$ which equals $6\times256$, one would have $6\times2^{16}$, which equals $6\times65536$. The improvement factor thus achieved in practicing that invention would be represented by the fraction 65536/256 or 256.

It was taught in Applicant's now abandoned application Ser. No. 184,453, filed on Apr. 18, 1988, that the stacked motionless mixer described in Applicant's U.S. Pat. No. 4,614,440 could be particularly advantageous in the introduction of very small quantities of low viscosity liquids into very high viscosity extrudate melt systems or other high viscosity fluid streams if certain modifications were made which constitute the contribution of the present invention. The introduction of a low viscosity liquid such as a liquid colorant or lubricant to be added to a polymer stream, is quite difficult, for with most static mixer technology, small quantities of the low viscosity additive tend to tunnel through the mixer without being properly mixed.

Attempts have been made to solve this problem by introducing the low viscosity additions by multi-hold spargers or slotted sparger pipes. This approach is simply inadequate for the higher viscosity material governs the flow patterns and such devices will only operate at one flow rate for uniform additive distribution from the holes or slots. Asymmetrical plugging of the additive holes or slots invariably occurs.

Applicant disclosed yet a further embellishment to the above-described mixing device in its U.S. patent application Ser. No. 313,443, filed on Feb. 22, 1989, now abandoned. That application disclosed a mixing device which incorporated an individual biscuit section which was aligned across the longitudinal axis of the conduit. The biscuit possessed a plurality of openings wherein within each opening was located mixing elements which would induce a rotational angular velocity to the fluid stream passing therethrough wherein all of the mixing elements induced the same rotational sign to the fluid. This device is shown in FIGS. 5 and 6 wherein element 33 is shown located within conduit 20 to confront main fluid stream traveling in the direction of arrows 34. Also shown, for the first time, was the use of forward and rear faces 51 and 52 of biscuit element 33 which are sloped to prevent "dead spots" on the face of the biscuit element from acting as fluid shelves, trapping fluid components which otherwise were intended to pass through the biscuit element to become part of the mixture.

FIG. 5 shows fluid entry port 29 fed to the apex of conically-shaped plug 21 which was aligned along the longitudinal axis of biscuit 33 and cylindrical conduit 20. As such, the apex of conically-shaped plug provided the first point of contact of fluid emanating from fluid entry port 29.

In the embodiment of FIG. 5, fluid entry port 29 was fed via feed leg 27 which passed through conically-shaped conduit 20 and extended radially within the conduit. In the embodiment of FIG. 5, second leg 28 was deployed substantially along the longitudinal axis of conduit 20 which oriented the fluid emanating from fluid entry port 29 in the direction of main flow 34.

As shown in FIG. 6, yet another embodiment of the invention was disclosed whereby fluid entry port 37 was shown as being an integral part of conically-shaped plug 21*a*. In this embodiment, fluid emanating from entry port 37 was fed from a first leg 35 which passed through conically-shaped conduit 20 and which extended radially within biscuit 33 and through a second feed leg 36 which extended from first feed leg 35 along the longitudinal axis of the biscuit for the discharge of fluid substantially at the apex of the conically-shaped plug 21*a*. It was the intent of Applicant in providing the embodiment of FIG. 6 to provide a feed point 37 enabling fluid to spill over conically-shaped plug 21*a* uniformly about the surface of this conically-shaped member providing a waterfall effect for feeding each of orifices 6, etc., with substantially equal amounts of this fluid.

Although the various embodiments disclosed above provided a vast improvement over preexisting mixing devices particularly when dealing with the introduction of very small quantities of low viscosity liquids into very high viscosity extrudate melt systems or other high viscosity fluid strains, certain deficiencies remained which require rectification. For example, when the device shown in FIG. 5 was employed, great care had to be exercised to get the injection point exactly aligned with the center of the biscuit. This was found to be particularly critical at very low flow rates of additive. Any misalignment would result in the additive tunnelling down one side of the biscuit rendering the device ineffective.

In addition, it was found that when the specific gravity of the additive was very different from that of the main flow, for example, when a difference of 10 percent or more existed and when the viscosity of the additive was very low, surface tension became an important factor. Additive which touched the side walls of the conduit was moved by capillary attraction, either up or down the conduit walls to accumulate along the upper or lower region of the conduit, depending upon its specific gravity relative to the main flow. This phenomenon was obviously detrimental to the effective mixing of the various components It is thus an object of the present invention to provide a device which overcomes and substantially rectifies the problems recited above.

This and further objects will be more readily appreciated when considering the following disclosure and amended claims wherein:

SUMMARY OF THE INVENTION

The present invention deals with a stationary material mixing apparatus as well as for a method of using this apparatus for mixing two or more fluids. The stationary material mixing apparatus is located within a cylindrically-shaped conduit, the conduit having a longitudinal axis and circular cross-section of a first diameter.

The material mixing apparatus comprises a biscuit which is aligned along the longitudinal axis of the conduit. The biscuit possesses an upstream face and downstream face, a second diameter, and a plurality of openings where within each opening is located mixing elements which induce a rotational angular velocity to the fluid stream passing therethrough. The apparatus is further characterized such that substantially all of the mixing elements induce the same rotational sign to the fluid.

The biscuit supports a frustum of a cone emanating from its upstream face. The frustum is aligned along the longitudinal axis of the conduit.

A feed leg is provided extending radially from the side wall of the conduit downstream of the biscuit. The feed leg is in fluid communication with a bore located within the biscuit along the longitudinal axis thereof for the discharge of fluid from an opening located at the apex of the frustum.

The present material mixing apparatus is characterized such that the first diameter of the conduit is greater than the second diameter of the biscuit. As such, a substantially uniform annular gap is established between the biscuit and conduit.

DETAILED DESCRIPTION OF THE INVENTION

Figure 1:
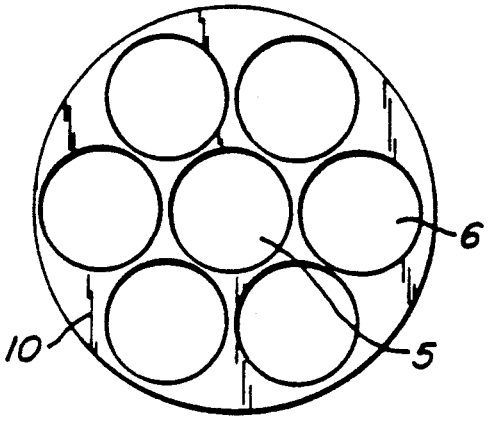
FIG. 1. PRIOR ART
FIGS. 1 through 6 represent prior art devices discussed above.
Figure 2:
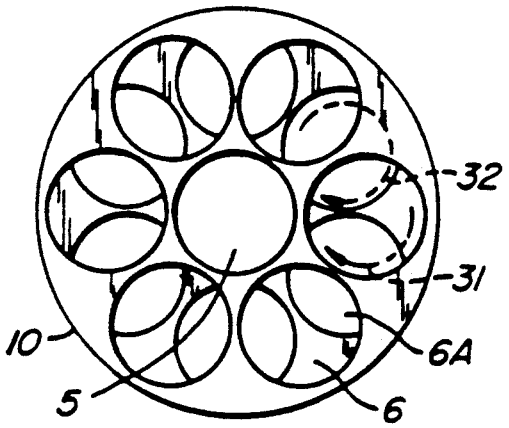
FIG. 2. PRIOR ART
Figure 3:
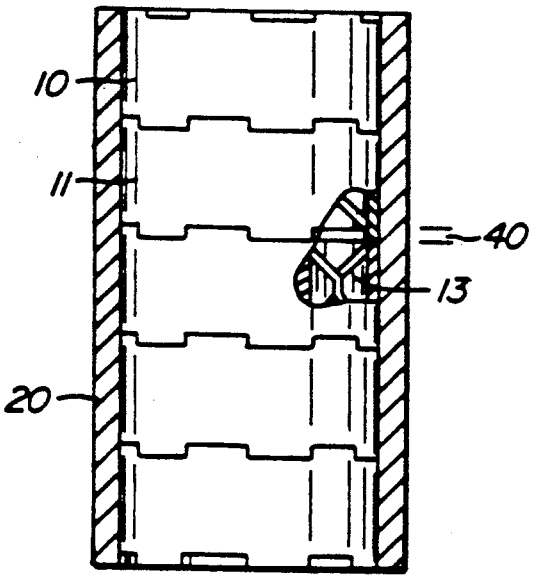
FIG. 3. PRIOR ART
Figure 4:
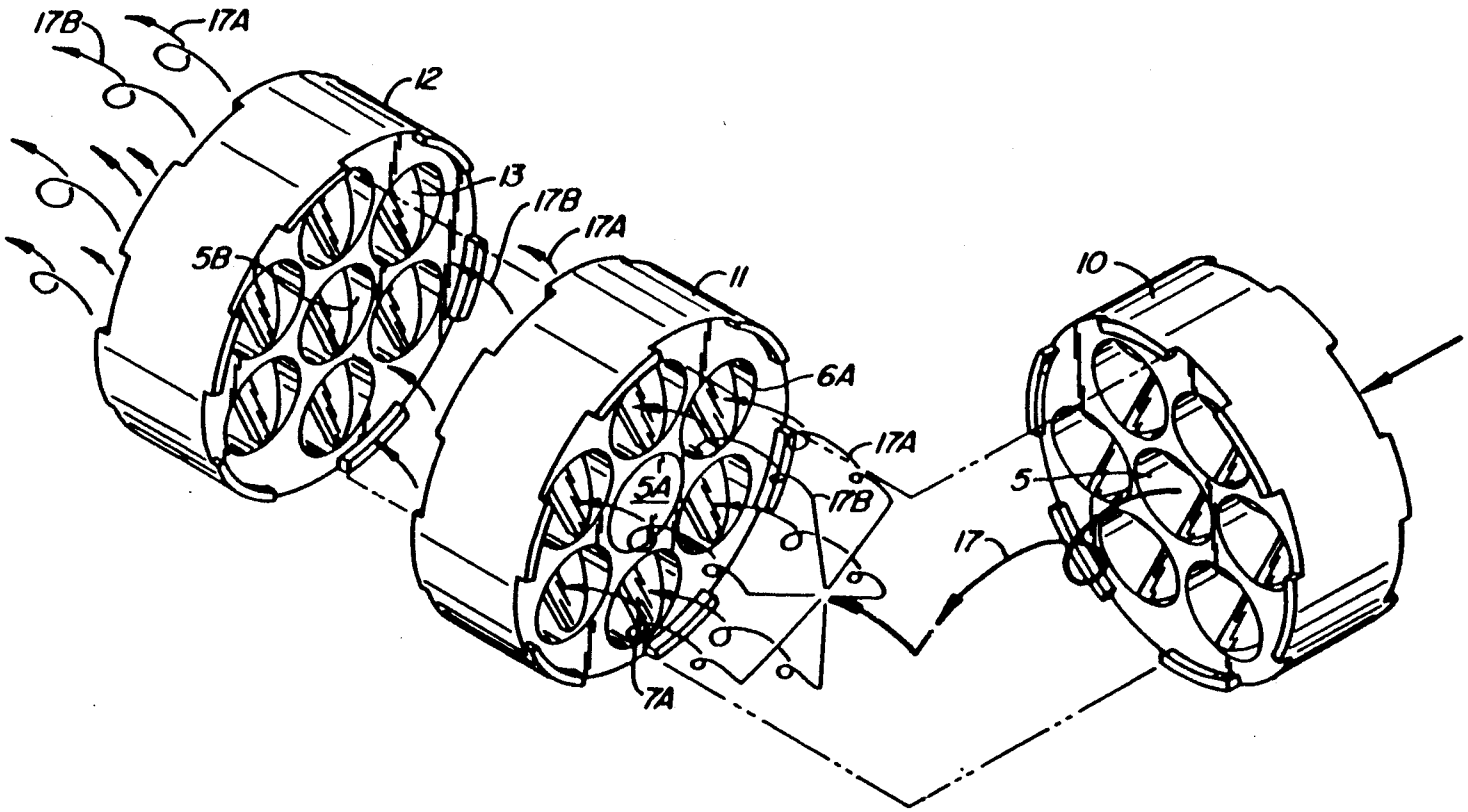
FIG. 4. PRIOR ART
Figure 8:
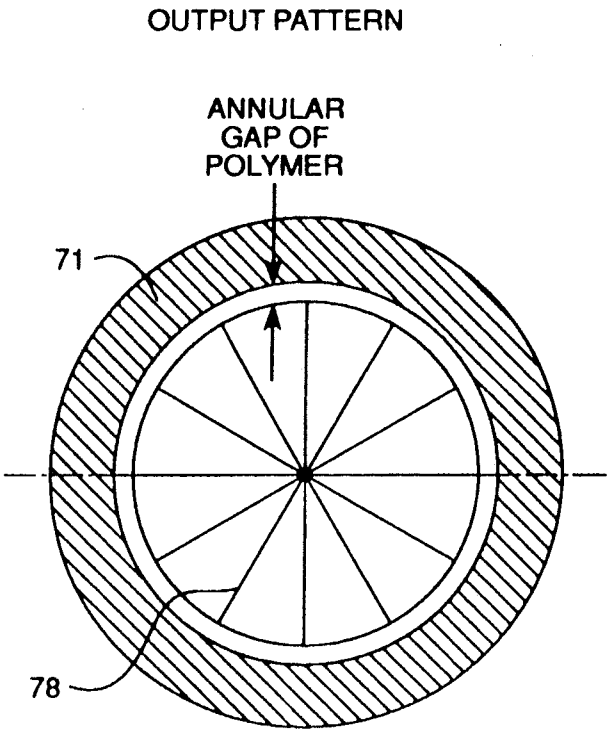
FIG. 8 is an illustration of the output pattern of additive emanating from the mixing device of the present invention.
Figure 7:
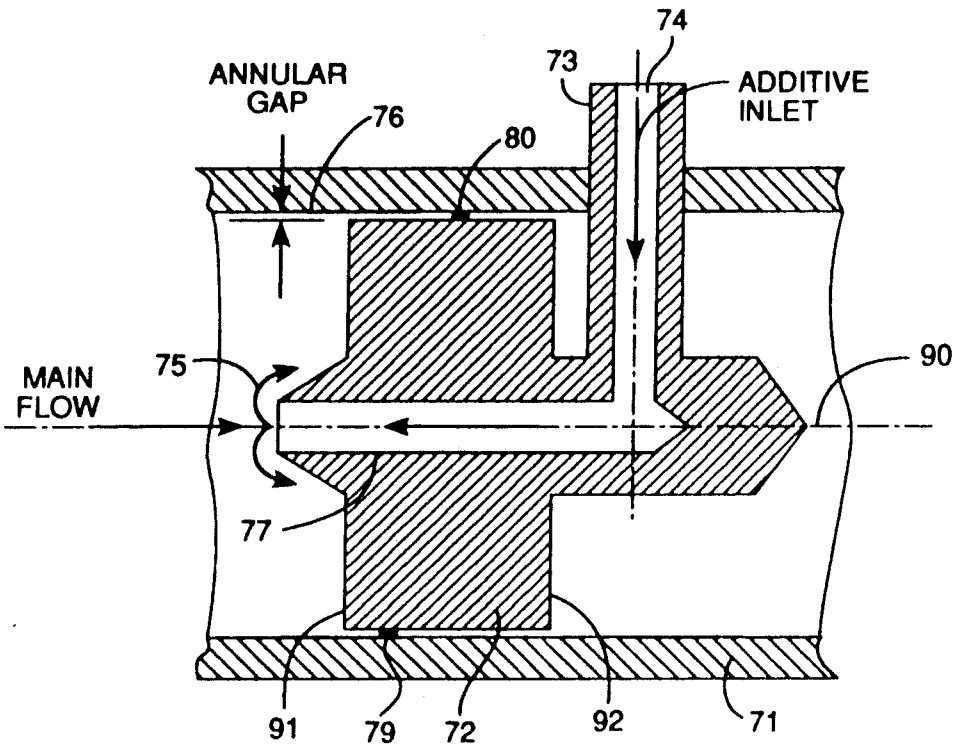
FIG. 7 depicts, in cross-section, the mixer apparatus of the present invention.

Referring to FIG. 7, a stationary material mixing apparatus 72 is shown located within cylindrically-shaped conduit 71 having a longitudinal axis 90 and a circular cross-section best seen by referring to FIG. 8. The biscuit or material mixing apparatus 72 is aligned along longitudinal axis 90 while possessing upstream face 91 and downstream face 92 and a second diameter. A plurality of openings (not shown) are established within the biscuit in a manner depicted by the individual biscuit elements 10, 11 and 12 of FIG. 4 which contain mixing elements which induce a rotational angular velocity to the fluid stream passing therethrough. As noted previously, the apparatus is characterized such that substantially all of the mixing elements induce the same rotational sign to the fluid.

Biscuit 72 supports a frustum of a cone 77 emanating from upstream face 91. The frustum is aligned along longitudinal axis 90 as shown in FIG. 7.

Feed leg 73 is shown emanating from side wall of conduit 71 downstream of biscuit element 72. Feed leg 73 is in fluid communication with bore 74 located within biscuit 72 along longitudinal axis 90. As such, a low viscosity additive can be introduced to the main flow within conduit 71 through feed leg 73, bore 74 and an opening located at the center of frustum 77 as shown by virtue of arrow 75.

Conduit 71, as noted previously, is characterized as having a circular cross-section of a first diameter as shown in FIG. 8. Material mixing apparatus or biscuit 72 also has a circular cross-section of a second diameter, smaller than the conduit's first diameter. As such, an annular gap is established substantially uniformly between the biscuit and conduit. As a preferred expedient, to maintain that gap, protrusions 79 and 80 are provided. These can be established conveniently by welding sets of buttons on the outside of biscuit 72 followed by machining the buttons to get all of them to the same height. Ideally, an annular gap of approximately two percent of the conduit's inside diameter has been found to work well in the practice of the present invention.

It has been found that the device of the present invention causes the additive emanating from frustum 77 to be distributed as thin radial sheets 78 (FIG. 8). This produces a larger interfacial surface area between the additive and the main component flow within the conduct.

Figure 5:
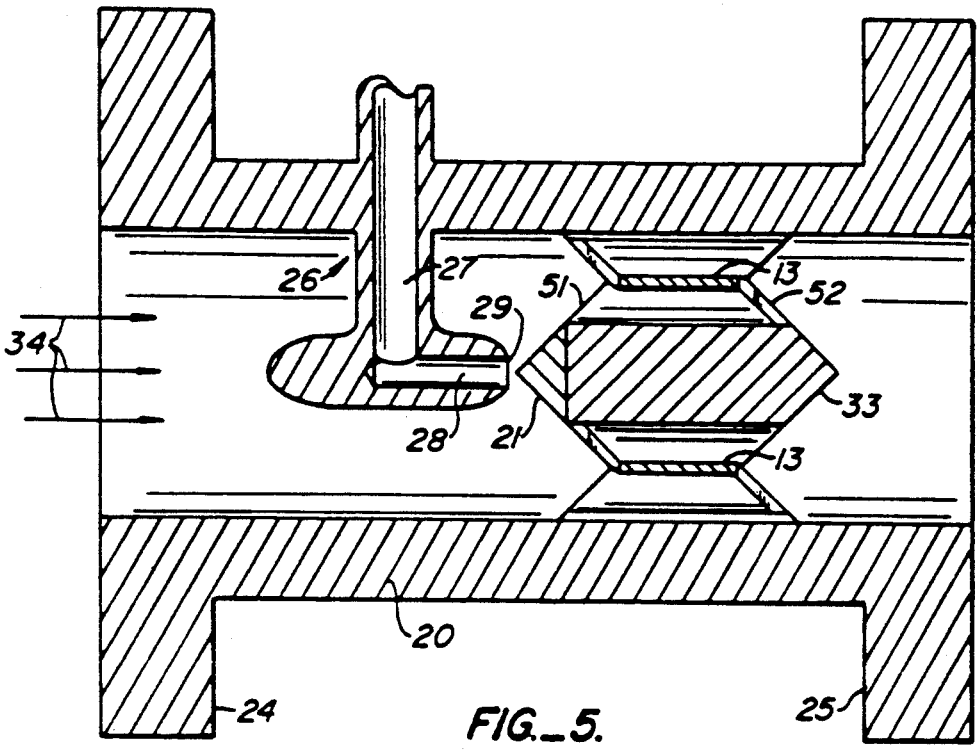
FIG. 5. PRIOR ART
Figure 6:
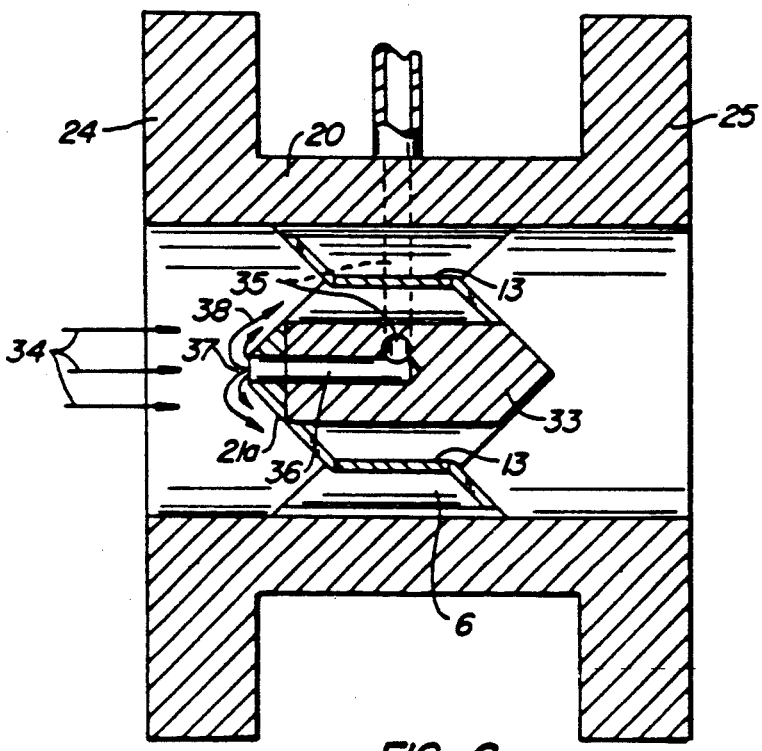
FIG. 6. PRIOR ART

It was found that when a device such as shown in FIG. 5 was employed, great care had to be exercised to be sure that the injection point of the additive was exactly aligned with the center of the biscuit module. This was found to be particularly critical at very low flow rates of additive, on the order of less than one percent. If this was not done, the additive tended to tunnel down one side of the biscuit rendering the mixing apparatus ineffective.

It was also found that when the specific gravity of the additive was very different from that of the main flow, for example, 10 percent or more, and when the additive exhibited a very low viscosity, surface tension came into play. Additive which touched the walls of conduit 71 moved by capillary attraction, either up or down on the conduit walls, to accumulate along the upper or lower regions of the conduit, depending upon its specific gravity relative to the main flow.

The present invention eliminates the difficulties recited above by introducing the additive downstream of biscuit 72 and by providing the above-recited substantially uniform annular gap. The latter expedient enables a portion of the main flow to travel through the annular gap outside and around biscuit 72 which prevents the downstream or output additive sheets 78 from contacting conduit 71 sidewalls.

Furthermore, by injecting additive through the centrally located opening of frustum 77, alignment problems such as those experienced in practicing the invention shown in FIG. 5 are eliminated. By employing the mixing apparatus of FIG. 7, one is ensured of always having uniform distribution of additive throughout biscuit 72.

I claim:

1. A stationary material mixing apparatus located within a cylindrically-shaped conduit, said conduit having a longitudinal axis and circular cross-section of a first diameter, said material mixing apparatus provided for mixing a fluid stream with the conduit and comprising a biscuit which is aligned along said longitudinal axis, said biscuit possessing an upstream face and downstream face, second diameter, and a plurality of openings where within said openings are located mixing elements which induce a rotational angular velocity to the fluid stream passing therethrough, said apparatus being further characterized such that substantially all of said mixing elements induce the same rotational sign to said fluid, said biscuit supporting a frustum of a cone emanating from the upstream face thereof and aligned along said longitudinal axis, a feed leg radially emanating from the side wall of said conduit downstream of said biscuit is provided which is in fluid communication with a bore located within said biscuit along said longitudinal axis thereof for discharge of a fluid from an opening located at the apex of said frustum, said material mixing apparatus being further characterized wherein said first diameter of said conduit is greater than the second diameter of said biscuit such that an annular gap is established substantially uniformly between said biscuit and conduit.

2. The apparatus of claim 1 wherein said substantially uniform annual gap is maintained by providing two or more protrusions emanating from said biscuit.

3. The apparatus of claim 2 wherein said two or more protrusions are of a substantially uniform height emanating from said biscuit.

4. The apparatus of claim 3 wherein said protrusions are located in at least two sets of three or more protrusions, each set being in radial planes spaced substantially uniformly from said biscuit.

5. The apparatus of claim 1 wherein a first fluid is contained by said conduit and a second fluid is introduced at the apex of said frustum for mixing with said first fluid.

6. The apparatus of claim 5 wherein the specific gravity of said first fluid is approximately at least 10% greater than the specific gravity of said second fluid.

7. The apparatus of claim 6 wherein a portion of the first fluid is caused to pass through said annular gap thus substantially preventing said second fluid from contacting the side wall of said conduit.

8. A method of mixing a second fluid of relatively low viscosity into a first fluid of relatively high viscosity, said first fluid passing within the interior bore of a cylindrically shaped conduit, said conduit having a longitudinal axis and circular cross-section of a first diameter, providing a material mixing apparatus within the conduit comprising a biscuit aligned along said longitudinal axis, said biscuit possessing an upstream face and downstream face, second diameter sized smaller than said first diameter to provide a substantially uniform annular gap between said biscuit and conduit, and also possessing a plurality of openings wherein within said openings are located mixing elements which induce a rotational angular velocity to the fluid stream passing therethrough and same rotational sign, said biscuit supporting a frustum of a cone emanating from the upstream face thereof and aligned along said longitudinal axis, a feed leg radially emanating from the side wall of said conduit downstream and said biscuit and which is in fluid communication with a bore located within said biscuit along said longitudinal axis, passing said second fluid through said feed leg and bore and discharging said fluid from said frustum so that substantially all of said first and second fluids pass through said plurality of openings and a portion of only said first fluid passes through said annular gap.

* * * * *